US010060374B2

(12) United States Patent
Shen et al.

(10) Patent No.: US 10,060,374 B2
(45) Date of Patent: Aug. 28, 2018

(54) ENGINE SYSTEM AND METHOD

(71) Applicant: General Electric Company, Schenectady, NY (US)

(72) Inventors: Ning Shen, Erie, PA (US); Matthew K. Ferguson, Erie, PA (US); Dominick Travaglini, Ocean View, DE (US)

(73) Assignee: General Electric Company, Schenectady, NY (US)

( * ) Notice: Subject to any disclaimer, the term of this patent is extended or adjusted under 35 U.S.C. 154(b) by 182 days.

(21) Appl. No.: 15/140,566

(22) Filed: Apr. 28, 2016

(65) Prior Publication Data

US 2016/0319763 A1 Nov. 3, 2016

Related U.S. Application Data

(60) Provisional application No. 62/154,476, filed on Apr. 29, 2015.

(51) Int. Cl.
*F02D 41/20* (2006.01)

(52) U.S. Cl.
CPC ..... *F02D 41/20* (2013.01); *F02D 2041/2017* (2013.01); *F02D 2041/2027* (2013.01); *F02D 2041/2034* (2013.01); *F02D 2041/2051* (2013.01); *F02D 2041/2058* (2013.01)

(58) Field of Classification Search
CPC ..... F02D 41/3005; F02D 41/20; F02D 41/26; F02D 41/32
See application file for complete search history.

(56) References Cited

U.S. PATENT DOCUMENTS 4,190,022 A * 2/1980 Long ..... F02D 41/20 123/490
6,031,707 A 2/2000 Meyer
7,024,257 B2 * 4/2006 Pearce ..... H04J 3/0682 318/562
2011/0220067 A1 9/2011 Okonogi et al.

* cited by examiner

*Primary Examiner* — Jacob Amick
(74) *Attorney, Agent, or Firm* — GE Global Patent Operation; John A. Kramer

(57) ABSTRACT

Various methods and systems are provided for controlling and shaping the current waveform for a solenoid in a fuel injector that has variable impedance.

19 Claims, 9 Drawing Sheets

ENGINE SYSTEM AND METHOD

CROSS REFERENCE TO RELATED APPLICATIONS

This application claims priority to U.S. Provisional Application No. 62/154,476, filed Apr. 29, 2015, which is hereby incorporated in its entirety herein by reference for all purposes.

BACKGROUND

Technical Field

Embodiments of the subject matter disclosed herein relate to methods and systems for control systems for fuel injectors in an engine.

Discussion of Art

In some vehicles, fuel is provided to an engine by a common rail fuel system. In the common fuel rail system, fuel injectors inject fuel from the common fuel rail to cylinders of the engine for combustion. The injectors open via actuation from a solenoid valve controlled by a controller. To initiate injection of a given injector, the controller sends a signal to activate the solenoid valve of that injector, resulting in a voltage source being applied to the solenoid. Once the current in the solenoid reaches a threshold, the valve opens and injection begins. However, in some configurations, the duration from when the voltage source is applied to the solenoid to the time when the current rises to the threshold value may vary among injectors, and may also vary based on operating conditions. This may result in differing start of injection times among cylinders, degrading combustion and potentially reducing fuel efficiency and emissions.

BRIEF DESCRIPTION

A system is provided that includes a first fuel injector coupled to a first fuel injector drive circuit and that is operable to inject fuel to a first cylinder, and a controller coupled to the first fuel injector drive circuit. The controller may generate an adjusted first actuation signal to the first fuel injector based at least on an impedance to the first actuation signal.

In one example, the controller is configured to adjust the first actuation signal of the first fuel injector by adjusting a rate of current rise of the first fuel injector circuit to track a reference current rise. The first actuation signal may include voltage applied to and flow of current through a solenoid of the first fuel injector drive circuit. As impedance of the first fuel injector and/or first fuel injector drive circuit changes, the first actuation signal may be adjusted by adjusting modulation of a switch controlling the voltage applied to the solenoid. In one example, the switch may be modulated based on feedback from a current sensor that measures current flowing through the solenoid in order to track a reference current waveform. In this way, regardless of the impedance to the first actuation signal, the current at the solenoid may be maintained at a reference current, thus allowing the timing of the start of fuel injection as well as the duration of the fuel injection event to be precisely controlled.

Further, in systems that include multiple fuel injectors, impedance may vary from injector to injector, and the voltage source impedance and applied voltage tolerance may vary from injector drive circuit to injector drive circuit. Thus, each fuel injector and injector drive circuit may be controlled to have a current waveform that tracks the reference current waveform, thus mitigating fuel injection timing differences among fuel injectors.

Further still, the fuel injector drive circuit may be controlled via linear source, pulse width modulated without averaging, pulse width modulated wave shaped half sinewave, or pulse width modulated with an averaging filter. Using an averaging filter may lower electromagnetic interference (EMI) by avoiding abrupt signals down long lead (e.g., wire) lengths.

DETAILED DESCRIPTION

Figure 1:
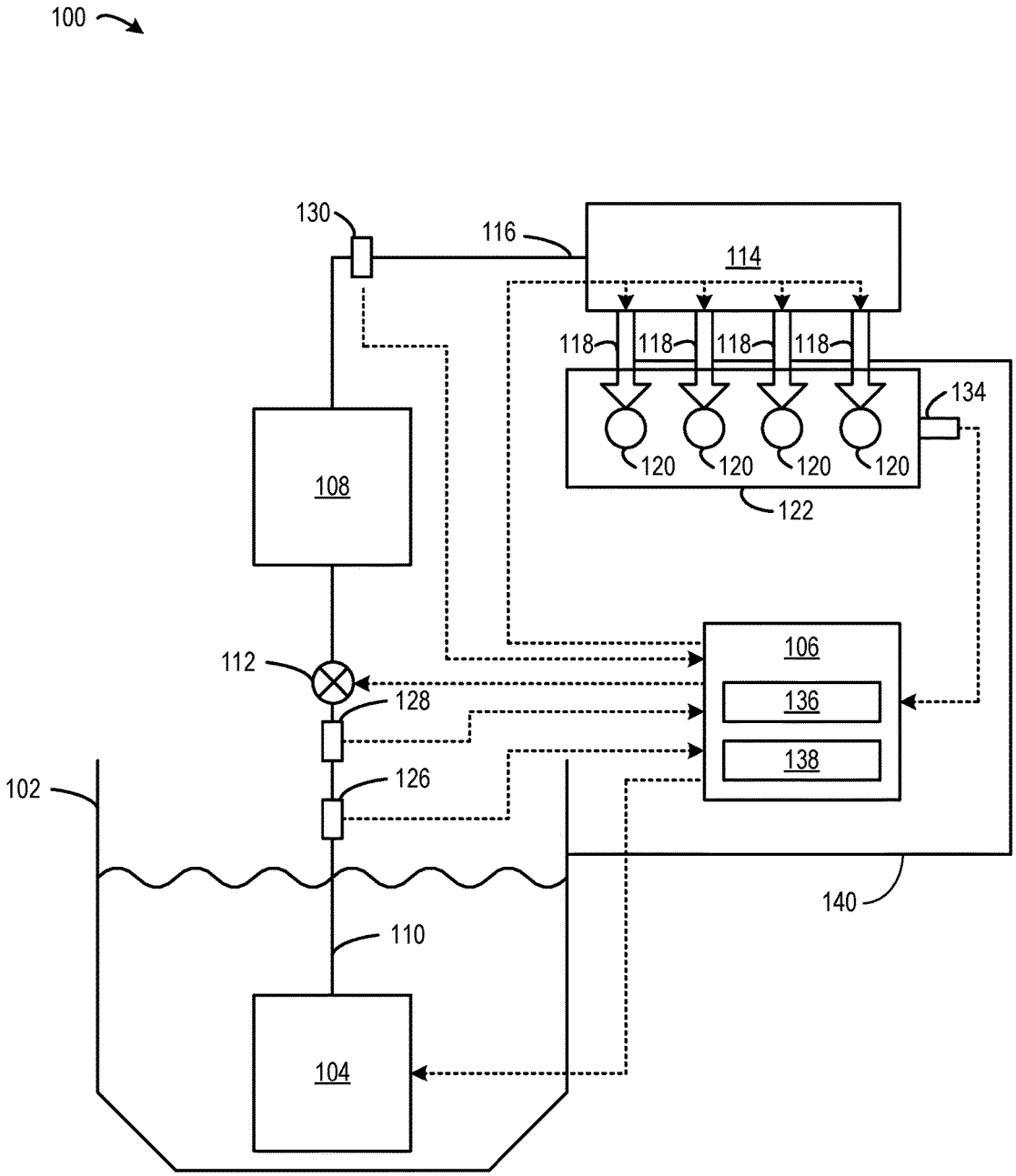
FIG. 1 is a schematic diagram of a fuel system according to an embodiment of the invention.

The following description relates to various embodiments of controlling an actuation signal to switch an actuator from a first position to a second position. The actuator may be a suitable actuator that may benefit from tightly-controlled timing of the actuation switch, such as engine system actuators including a fuel injector, spark plug, intake or exhaust system valve, or other actuator. Additionally, the actuation signal may be controlled so that the actuator switches from the first position to the second position at an equivalent time that a second actuator switches from a first position to a second position. For example, two fuel injectors may be controlled to both open at the same time in respective cylinder cycles. To control the actuation signal, the current supplied to each actuator may be monitored and an average voltage supplied to each actuator may be adjusted such that the monitored current for each actuator tracks a reference current waveform. The reference current waveform may include a threshold current at which the actuator switches from the first position to the second position.

In embodiments having fuel injection systems with multiple injectors or with multiple injectors per cylinder, the adjusted time among one or more of the injectors may be controlled to account for a delay factor that causes some solenoids to reach the threshold current faster (or slower) than other solenoids, or to stay open relatively longer or not as long. In one example, the delay factor may include the impedance of the wiring within the fuel injector circuit. The solenoid, voltage source, controller, and intervening wiring creates a circuit. In one embodiment, an impedance and/or time delay may be correlated to one or more wiring factors of the wiring, for example. Wiring factors may include one or more of the following: the wire composition (copper, aluminum, graphite, e.g.), the wire length, the wire gauge or thickness, the level or type of shielding, as well as some environmental parameters. Suitable environmental parameters may include the electromagnetic noise level to which one of the wires may be subject (which may differ based on the path of one wire relative to another of the wires), the temperature, or even age, vibration and shock for wire types that are sensitive to such things (e.g., graphite core wires).

Collectively, these factors may be referred to as impedance to the injector signal that propagates through the wiring.

In one embodiment, there are multiple types of injectors. One suitable fuel system includes diesel fuel injectors and natural gas injectors. The relative controls, amount of current and voltage, sensitivity of the injector solenoids and the like may differ between the injector types even as, for example, pairs of injectors feed fuel into a common cylinder.

The impedance may affect the operation of one injector relative to another. When multiple injectors are coupled to the same controller and/or voltage source, the length of the wiring between each injector and the controller and/or voltage source may vary. As such, the impedance in each injector circuit may vary, leading to varying adjusted times.

According to embodiments disclosed herein, to control each injector circuit to track a reference current waveform and thus open at a target opening time, the current waveform during injection may be monitored and compared to the reference waveform. The difference between the measured and reference current waveform may be determined. If the difference is greater than a threshold value, the voltage source applied to the circuit may be adjusted to control the current waveform to track the reference waveform.

Figure 2:
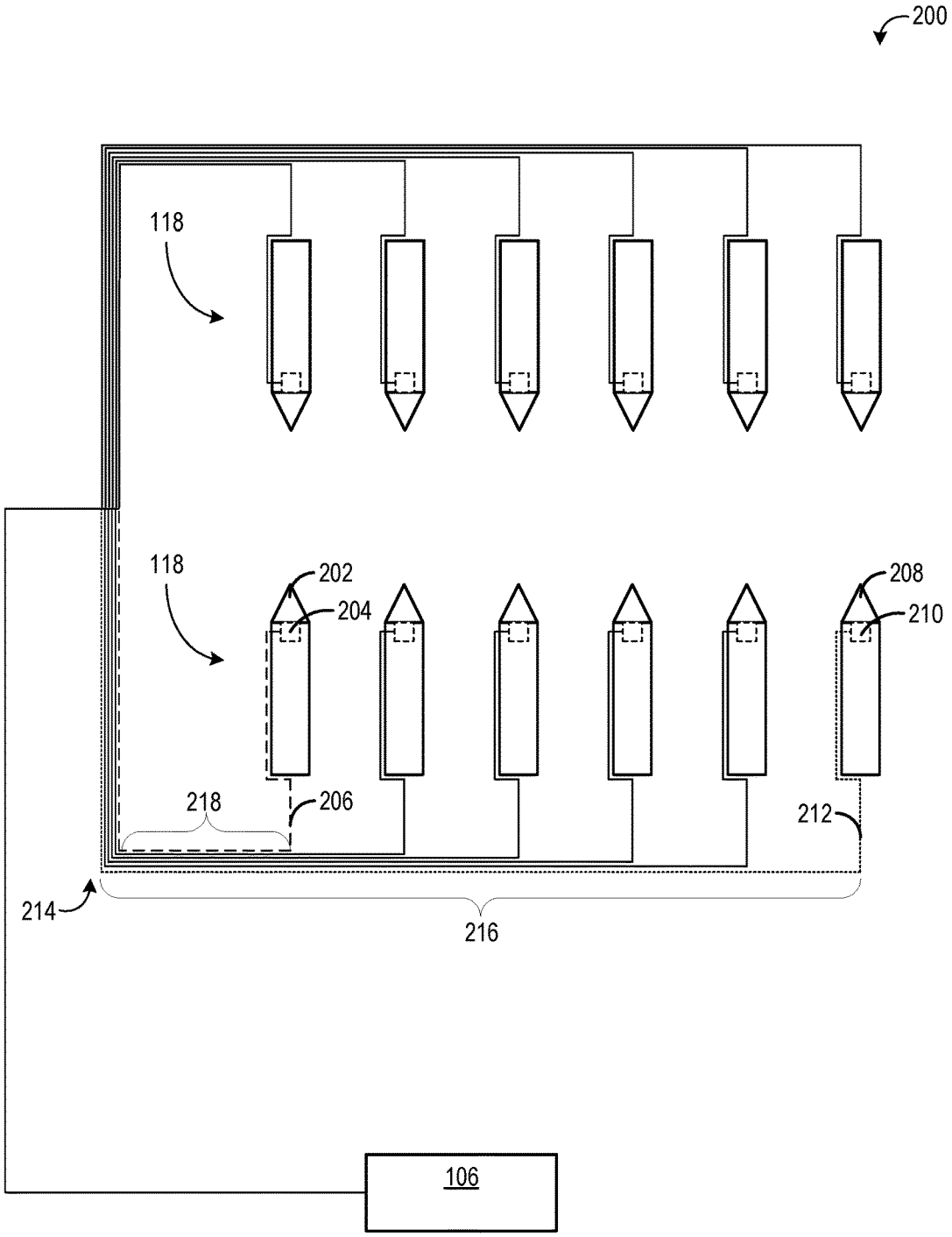
FIG. 2 is a schematic diagram of a plurality of fuel injectors of the fuel system of FIG. 1.
Figure 3:
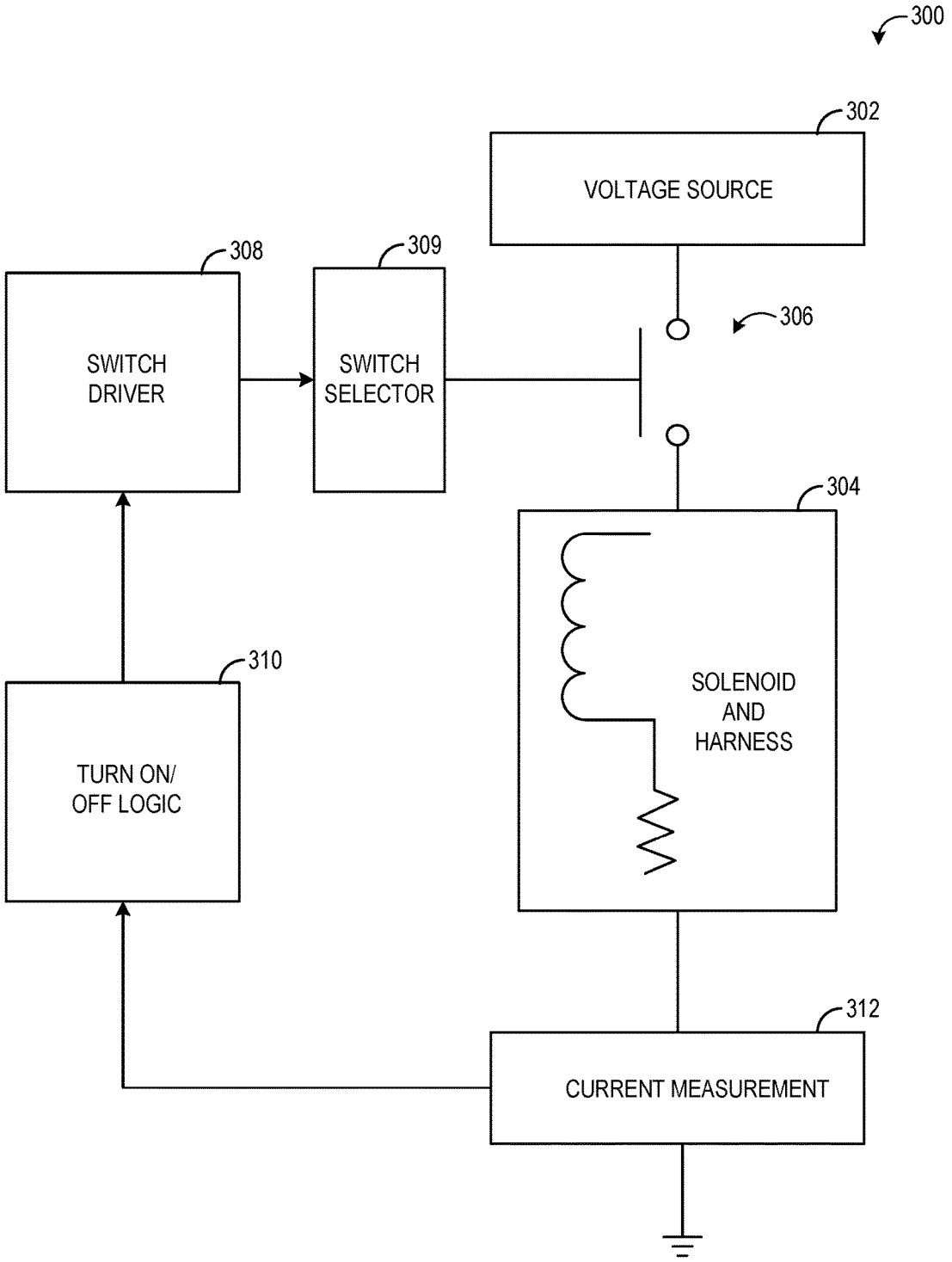
FIG. 3 is a schematic diagram of an embodiment of an injector circuit.
Figure 4:
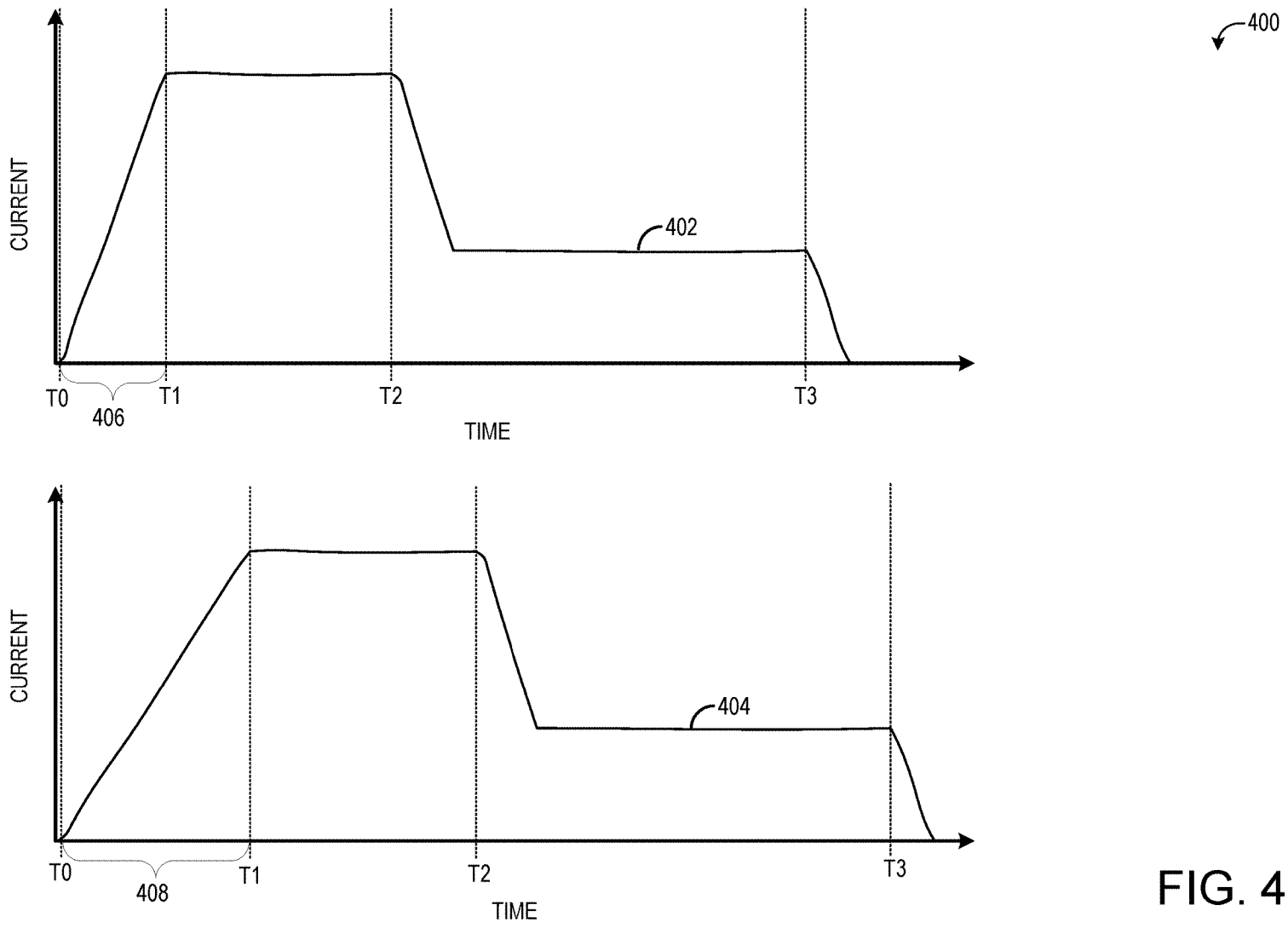
FIGS. 4, 7, and 9 are examples of current waveforms during fuel injection events for two fuel injectors.
Figure 5:
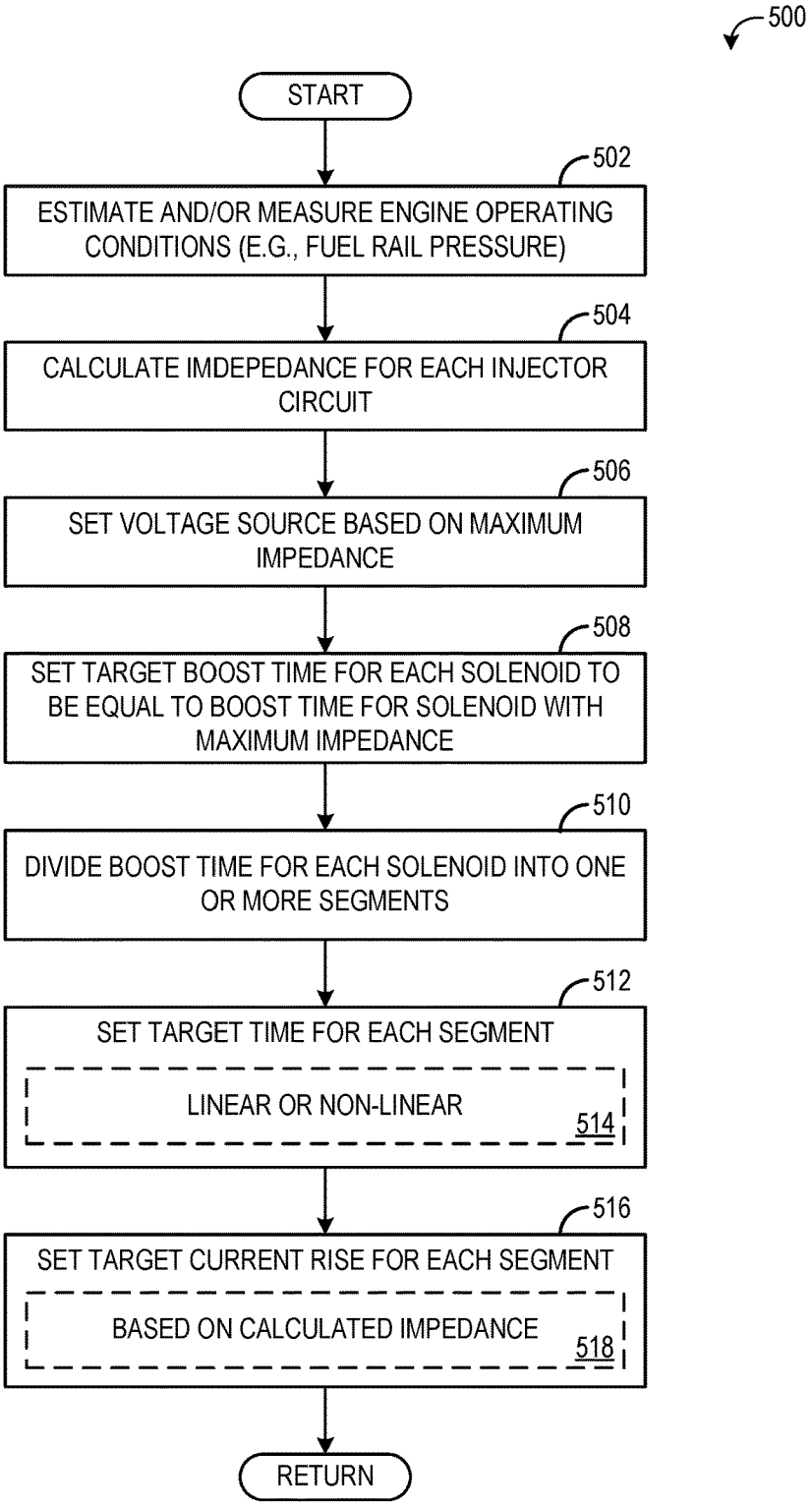
FIGS. 5, 6, and 8 are embodiments of methods for operating fuel injectors during injection events.
Figure 6:
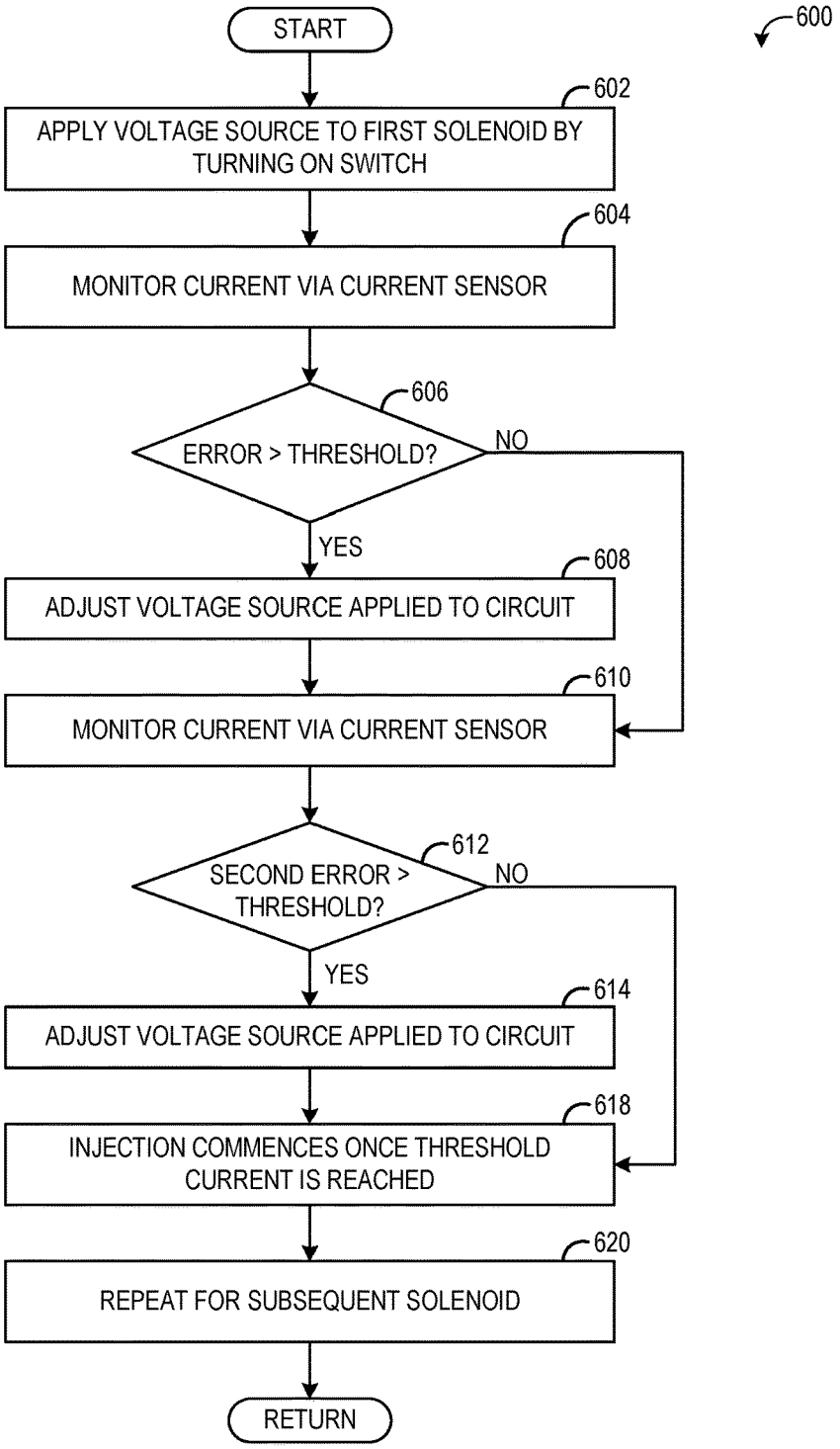
Figure 7:
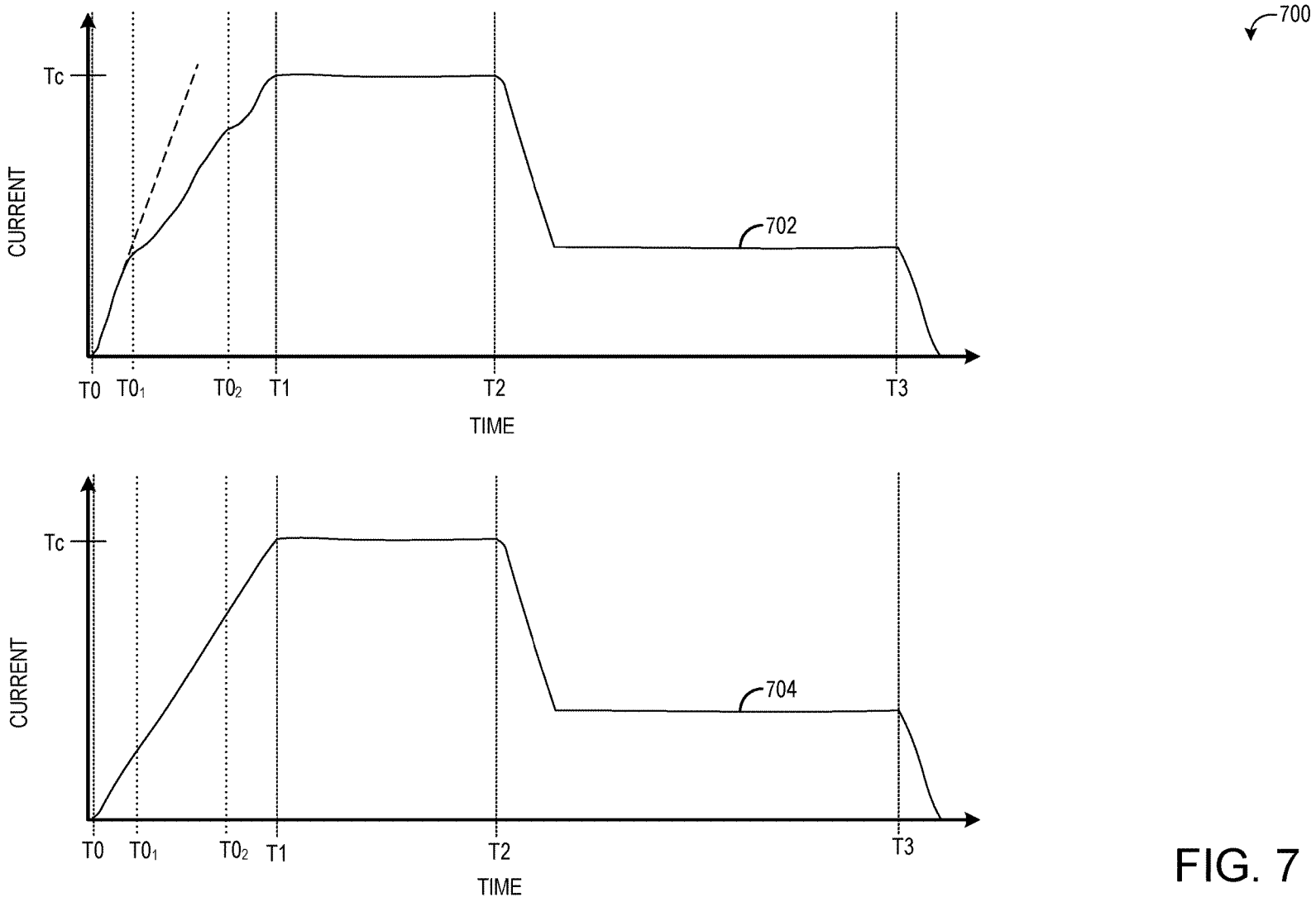
Figure 8:
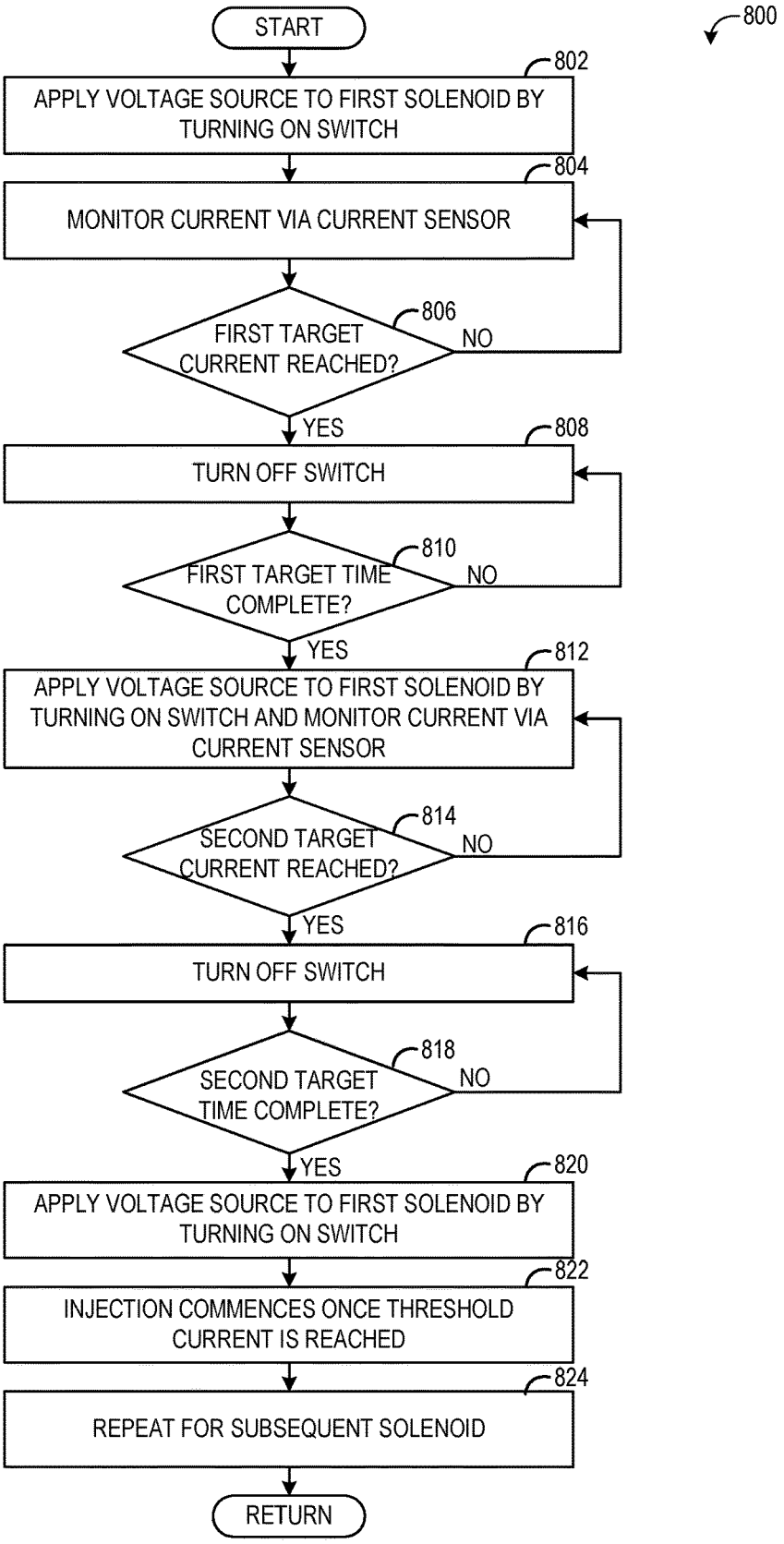
Figure 9:
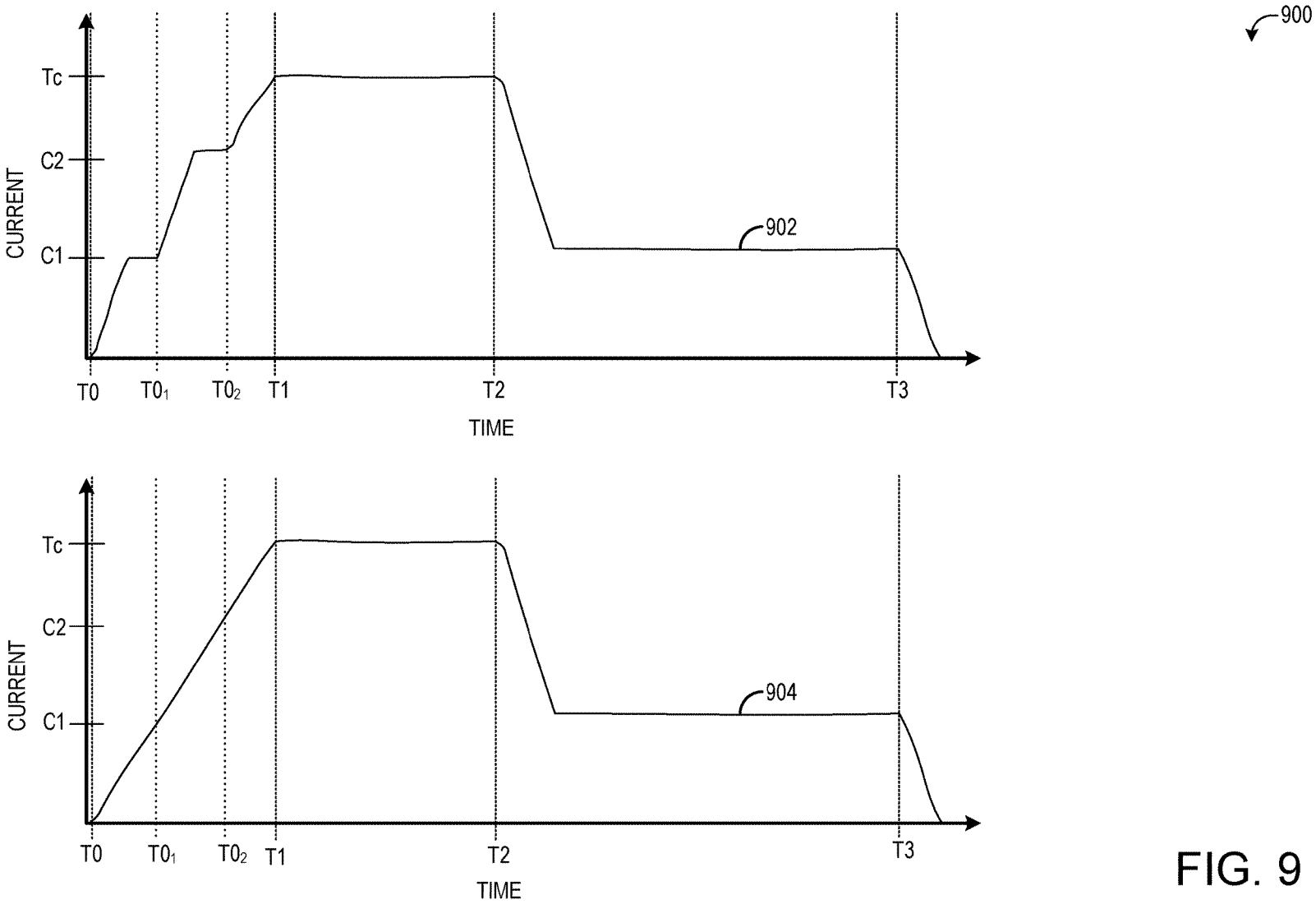

An example fuel system including a plurality of fuel injectors is shown at FIGS. 1-2. An example injector circuit is shown at FIG. 3, and example fuel injector current waveforms for two injectors of the system of FIG. 2 are shown in FIG. 4. FIGS. 5-6 are flow charts illustrating methods for controlling a plurality of fuel injector events. FIG. 7 shows current waveforms for two injectors controlled according to the method of FIG. 6. FIG. 8 is a flow chart illustrating another method for controlling a plurality of fuel injector events, and FIG. 9 shows current waveforms for two injectors controlled according to the method of FIG. 8.

The approach described herein may be employed in a variety of engine types, and a variety of engine-driven systems with modifications that are specific to the application. Some of these systems may be stationary, while others may be on semi-mobile or mobile platforms. Semi-mobile platforms may be relocated between operational periods, such as mounted on flatbed trailers. Mobile platforms include self-propelled vehicles. Such vehicles can include on-road transportation vehicles, as well as mining equipment, marine vessels, rail vehicles, and other off-highway vehicles (OHV).

Regarding controlling the fuel injector adjusted time, an example of a fuel system for an engine is disclosed. For example, FIG. 1 shows a block diagram of a common rail fuel system (CRS) 100 for an engine of a vehicle, such as a rail vehicle. Liquid fuel is sourced or stored in a fuel tank 102. A low-pressure fuel pump 104 is in fluid communication with the fuel tank 102. In the embodiment shown in FIG. 1, the low-pressure fuel pump 104 is disposed inside of the fuel tank 102 and can be immersed below the liquid fuel level. In alternative embodiments, the low-pressure fuel pump may be coupled to the outside of the fuel tank and pump fuel through a suction device. Operation of the low-pressure fuel pump 104 is regulated by a controller 106.

Liquid fuel is pumped by the low-pressure fuel pump 104 from the fuel tank 102 to a high-pressure fuel pump 108 through a conduit 110. A valve 112 is disposed in the conduit 110 and regulates fuel flow through the conduit 110. For example, the valve 112 is an inlet metering valve (IMV). The IMV 112 is disposed upstream of the high-pressure fuel pump 108 to adjust a flow rate of fuel that is provided to the high-pressure fuel pump 108 and further to a common fuel rail 114 for distribution to a plurality of fuel injectors 118 for fuel injection. For example, the IMV 112 may be a solenoid valve, opening and closing of which is regulated by the controller 106.

The high-pressure fuel pump 108 increases fuel pressure from a lower pressure to a higher pressure. The high-pressure fuel pump 108 is fluidly coupled with the common fuel rail 114. The high-pressure fuel pump 108 delivers fuel to the common fuel rail 114 through a conduit 116. A plurality of fuel injectors 118 are in fluid communication with the common fuel rail 114. Each of the plurality of fuel injectors 118 delivers fuel to one of a plurality of engine cylinders 120 in an engine 122. Fuel is combusted in the plurality of engine cylinders 120 to provide power to the vehicle through an alternator and traction motors, for example. Operation of the plurality of fuel injectors 118 is regulated by the controller 106. In FIG. 1, only four fuel injectors and four engine cylinders are illustrated, however it is to understood that more or fewer fuel injectors and engine cylinders may be included in the engine.

Excess fuel in the fuel injectors 118 returns to the fuel tank 102 via a common fuel return 140. As such, the common fuel return 140 is coupled to the fuel tank 102. In one example, each fuel injector 118 has a fuel passage for returning fuel to the common fuel return 140. In other embodiments, the CRS 100 may not include a common fuel return 140.

Fuel pumped from the fuel tank 102 to an inlet of the IMV 112 by the low-pressure fuel pump 104 may operate at what is referred to as a lower fuel pressure or engine fuel pressure. Correspondingly, components of the CRS 100 which are upstream of the high-pressure fuel pump 108 operate in the lower fuel pressure or engine fuel pressure region. On the other hand, the high-pressure fuel pump 108 may pump fuel from the lower fuel pressure to a higher fuel pressure or rail fuel pressure. Correspondingly, components of the CRS 100 which are downstream of the high-pressure fuel pump 108 are in a higher-fuel pressure or rail fuel pressure region of the CRS 100.

A fuel pressure in the lower fuel pressure region is measured by a pressure sensor 126 that is positioned in the conduit 110. The pressure sensor 126 sends a pressure signal to the controller 106. In an alternative application, the pressure sensor 126 is in fluid communication with an outlet of the low-pressure fuel pump 104. A fuel temperature in the lower fuel pressure region is measured by a temperature sensor 128 that is positioned in conduit 110. The temperature sensor 128 sends a temperature signal to the controller 106.

A fuel pressure in the higher fuel pressure region is measured by a pressure sensor 130 that is positioned in the conduit 116. The pressure sensor 130 sends a pressure signal to the controller 106. The controller 106 uses this pressure signal to determine a rail pressure of fuel (e.g., FRP) in the common fuel rail. As such, the fuel rail pressure (FRP) is provided to the controller 106 by the pressure sensor 130. In an alternative application, the pressure sensor 130 is in fluid communication with an outlet of the high-pressure fuel pump 108. Note that in some applications various operating parameters may be determined or derived indirectly in addition to or as opposed to being measured directly.

In addition to the sensors mentioned above, the controller 106 may receive various signals from a plurality of engine sensors 134 coupled to the engine 122 that may be used for assessment of fuel control health and associated engine operation. For example, the controller 106 receives sensor signals and then, based on these signals, determines one or more of air-fuel ratio, engine speed, engine load, engine temperature, ambient temperature, fuel value, a number of cylinders actively combusting fuel, and the like. In the illustrated implementation, the controller is a computing device, such as microcomputer that includes a processor unit 136, non-transitory computer-readable storage medium device 138, input/output ports, memory, and a data bus. The computer-readable storage medium included in the controller is programmable with computer readable data representing instructions executable by the processor for performing the control routines and methods described below as well as other variants that are not specifically listed.

The controller may adjust various actuators in the CRS based on different operating parameters received or derived from different signals received from the various sensors, to dynamically assess the health of the CRS and control operation of the engine based on the assessment. In one embodiment, the controller may adjust fuel injection to the engine. The controller may adjust fuel injection timing of one or more fuel injectors based on a determined injector activation time.

Turning now to FIG. 2, a schematic diagram 200 shows a plurality of fuel injectors 118 included in a common rail fuel system. The schematic shows twelve fuel injectors. The twelve fuel injectors are split up into two banks of six fuel injectors. In other embodiments, the common rail fuel system may include more or less than twelve fuel injectors. Each fuel injector injects fuel in a corresponding engine cylinder (not shown). In alternate examples, there may only be one bank of cylinders and one bank of fuel injectors 118.

Each injector of the plurality of fuel injectors 118 includes a solenoid valve which is coupled to the controller 106 via one or more wires (referred to herein as a harness). For example, first injector 202 includes first solenoid valve 204 coupled to the controller via first harness 206. Likewise, second injector 208 includes second solenoid valve 210 coupled to the controller via second harness 212. Each fuel injector of the plurality of fuel injectors 118 includes a solenoid valve coupled to the controller 106 via a separate harness. Further, as shown in FIG. 2, each harness may be joined together at one or more a common coupling points, such as point 214. When the harnesses are coupled to the controller, each harness may define an injector circuit with the controller and solenoid valve. Additional detail regarding a suitable injector circuit is described below with respect to FIG. 3.

When fuel injection from a particular injector is desired, the controller sends a signal to the solenoid valve of that injector. The signal may include application of a voltage source, such as a battery, to the circuit. When voltage is applied to the circuit, the current in the solenoid increases until it reaches a first threshold current, at which point the solenoid valve opens the fuel injector and fuel is dispensed. This initial rise in current in the solenoid may be referred to as the adjusted time. The current may be maintained in the solenoid to keep the injector open during one or more hold periods. Once the current drops to below a second threshold level (e.g., all the current is discharged from the solenoid), the solenoid valve closes the injector.

Based on the configuration of the plurality of fuel injectors, some injectors may be positioned closer to the controller than other injectors. For example, as shown in FIG. 2, the first injector is located closer to the controller than the second injector due to the first and second injectors being positioned on opposite ends of the cylinder bank. As a result, the first harness may be shorter than the second harness. For example, the portions of the harnesses that extend from the respective injectors to the common coupling point may be different in length. As shown, the second harness may have a length that is longer than the length of the first harness.

The differing lengths among the harnesses of the plurality of fuel injectors may result in corresponding different impedances among all the injector circuits. For example, as the length of a given harness increases, the impedance in that circuit increases. As such, the impedance of the circuit including the second injector may be larger than the impedance of the circuit including the first injector. Other factors that may lead to the disparity in impedances among injectors may be related to the injector itself. For example, the injector may have an inductor DC resistance (DCR) that may have a determined tolerance that is based at least in part on its temperature. Additionally, the injector has an associated inductance with a tolerance that may vary as a function of injector plunger position.

As described above, the adjusted time of a solenoid valve is the time it takes for the current in the solenoid to reach a threshold for opening the fuel injector, starting from when a voltage is source is applied to the circuit. The adjusted time is affected by the impedance in the circuit, such that as impedance increases, the adjusted time increases. In order to ensure that the start of injection for each cylinder occurs at the desired time during the combustion cycle (e.g., at or near TDC of the compression stroke), the voltage source may be applied at a time before the desired start of injection that corresponds to the adjusted time. However, as the current rise time is based on the impedance in the circuit, different injectors may have different adjusted times when the same voltage is applied to each injector circuit. This may result in varying start of injection times among injectors.

FIG. 3 is schematic 300 of an example injector circuit. The injector circuit includes a voltage source 302 (e.g., battery, alternator, booster, transformer and/or other suitable source) coupled to a solenoid/harness 304 via a switch 306. The switch may be controlled by a switch driver 308. The switch driver may be controlled by turn on/off logic 310. The on/off logic may include non-transitory instructions executable to control the switch driver in order to turn on and off the switch, as will be described in more detail below with respect to FIGS. 6 and 8. In some examples, the on/off logic may be included in a controller. The on/off logic may include an averaging filter, which reduces electromagnetic interference (EMI) and the AC content of the injector. The averaging filter may allow for the detection and removal of injector faults, such as shorts. In some examples, a switch selector 309 may be present to allow a common switch driver to go to several injectors, thereby reducing the driving electronics. The switch selector may thus determine which injector is driven at any time.

Additionally, a current measurement 312 may be taken of the current in the solenoid/harness and supplied to the on/off logic. The current may be measured by a current sensor or other suitable mechanism. Another current detection method may include emulation, where based on the volt seconds and inductance, the adjusted current may be extracted.

The illustrated injector circuit is an example of an injector circuit for one fuel injector of an engine (such as first injector of FIG. 2), and each fuel injector may be included in its own individual injector circuit. As such, each injector may include its own switch, harness, current measurement, and in some examples, switch driver. However, the on/off logic, switch driver, and/or voltage source may be common to one or more injectors; in one example, one voltage source and one on/off logic may be used for all the injectors of the engine.

As explained above, in order to initiate fuel injection via a first fuel injector, the on/off logic (e.g., controller) may control the switch of that injector (e.g., turn on the switch) so that voltage from the voltage source is supplied to the solenoid of that injector. The current in the solenoid begins to rise until a threshold current is reached, whereby the injector is opened. The current may be held relatively steady in a first hold period and a second hold period, via modulation of the switch, for example, until the desired amount of fuel has been dispensed, at which point the voltage is no longer applied to the circuit, the current is discharged, and the injector is closed. FIG. 4 is a plot 400 illustrating two example current waveforms during two fuel injection events performed via separate injectors, such as the first injector and second injector of FIG. 2, without controlling the adjusted time. For both waveforms, time is depicted along the horizontal axis and current is depicted along the vertical axis. While both waveforms are illustrated as having the same time axes, it is to be understood that this is for clarity of illustration only, and that the two waveforms may be collected during different time frames (e.g., different fuel injection events).

A first current waveform 402 represents the current during a fuel injection event for the first injector. At time T0, a signal is sent to initiate fuel injection and as a result, a switch of the injector circuit for the first injector is turned on and voltage is applied to the circuit. Current begins to rise until time T1, when current reaches the threshold and the solenoid opens the injector. From time T1 to T2, current is maintained at the threshold via modulation of the switch. At time T2 and until time T3, current is maintained at a second, lower current level. At time T3, the voltage source is no longer applied to the circuit, the current fully discharges, and fuel injection is complete. The time from T0 to T1 is an adjusted time 406 for the first injector. The time from T1 to T2 is the first hold period and the time from T2 to T3 is the second hold period. The holding current may be held constant with relatively little AC content, as shown. Thus, a specified DC level is provided along with an AC variation. While two holding periods are illustrated, in some examples only one holding period may be used.

A second current waveform 404 represents the current during a fuel injection event for a second injector. At time T0, a signal is sent to initiate fuel injection and as a result, a switch of the injector circuit for the second injector is turned on and voltage is applied to the circuit. Current begins to rise until time T1, when current reaches the threshold and the solenoid opens the injector. From time T1 to T2, current is maintained at the threshold via modulation of the switch. At time T2 and until time T3, current is maintained at a second, lower current level. At time T3, the voltage source is no longer applied to the circuit, the current fully discharges, and fuel injection is complete. The time from T0 to T1 is the adjusted time 408 for the second injector. The time from T1 to T2 is the first hold period and the time from T2 to T3 is the second hold period.

As seen in FIG. 4, the adjusted time for the first injector is shorter than the adjusted time for the second injector, due to a delay factor such as the increased impedance in the injector circuit for the second injector. As a result, the second injector will begin to inject fuel at a later time in the combustion cycle for the cylinder coupled to the second injector, as compared to when the first injector will begin to inject fuel in the combustion cycle for the cylinder coupled to the first injector. Said another way, both the first injector and the second injector may be commanded to inject fuel starting at the same time for each respective combustion cycle, but the second injector may actually start to inject fuel at a later time in the combustion cycle than the first injector. For example, the first injector may start injecting fuel to a first cylinder at 5° CA before TDC in the compression stroke for the first cylinder, while the second injector may start injecting fuel to a second cylinder at 1° CA before TDC in the compression stroke for the second cylinder, even though both injectors were commanded to start injection at 5° CA BTDC. Such discrepancies in the fuel injection timing may degrade engine performance, compromise emissions, or have other detrimental effects to the engine.

FIG. 6 is a flow chart illustrating a method for controlling the current waveform based on a reference waveform to control the adjusted time of two or more injectors that have different circuit impedance, such that the injectors are controlled to have the same adjusted time and hence the same injection start time, relative to their respective cylinder's combustion cycle. During the adjusted time for a given fuel injection event, the rate of current rise may be monitored and compared to a desired rate (based on a reference current waveform, for example). If the current rate deviates from the desired rate, the voltage source may be adjusted to bring the current to the desired rate. In other examples, the voltage may be switched on and off to maintain the current rise for each segment at the target current for the target time. While this type of threshold driven controller may be easy to implement, it may lead to variable frequency with abrupt switching edges, causing wide bandwidth EMI. The control of voltage to maintain target current for each segment of a given injector adjusted time is described below with respect to method 600 of FIG. 6.

Briefly, method 600 performs closed loop regulation on the current through the injector by varying the average voltage to the injector. The reference for the control loop is the current waveform desired vs. the current waveform measured. The control circuitry turns this comparison into an error signal (e.g., difference) which in turn controls a driver which varies the voltage to the injector to regulate its currents. Thus the method of control can be linear source, pulse width modulated without averaging, pulse width modulated wave shaped ½ sinewave, or pulse width modulated with an averaging filter. The last method may lead to the lowest EMI and avoid abrupt signals down long lead (e.g., wire) lengths. The closed loop feedback system which constantly controls the current in the injector regardless of what impedance is there may prevent loss of current profile fidelity if the impedances vary during the pulse.

Specifically, FIG. 6 illustrates a method 600 for controlling voltage applied to a fuel injector solenoid during a representative adjusted time (e.g., current rise time) of a fuel injection event. The disclosed method may be performed by a controller according to non-transitory instructions stored thereon, in order to control voltage applied to one or more fuel injector solenoid valves of a fuel system, such as the fuel system illustrated in FIGS. 1-2.

At 602, a voltage source is applied to a first solenoid by turning on a switch between the first solenoid and voltage source. For example, as shown in FIG. 3, a switch may be present between a voltage source and solenoid. The switch may be controlled by a switch driver according to switch on/off logic (e.g., the controller). When the switch is turned on, voltage is applied to the injector circuit, causing an increase in the current at the solenoid. This current is monitored via a current sensor, for example, as indicated at 604.

At 606, it is determined if an error between the measured current and a desired current is greater than a threshold. The desired current may be determined based on a reference current waveform. The reference current waveform may be predetermined and stored in memory of the controller, or the reference current waveform may be determined in real time (described in more detail below with respect to FIG. 5). The reference current waveform may be based on the type of injector (e.g., liquid fuel versus gaseous fuel injector) and may define the amount of current needed to open the injector (e.g., the threshold current) and the amount of current for each hold time, as well as the duration for the rise time and each hold time. Thus, the desired current may be determined to be the current at a given point in time on the reference current waveform.

In some examples, the monitored current may include an average current or average current rise rate determined over a given time segment. For example, the reference current waveform may be divided into a plurality of segments and each segment may be assigned a target time. The assignment of target times for each segment may made linearly or non-linearly. That is, each segment may have the same target time (e.g., linear) or one or more segments may have different target times (e.g., non-linear). When linear target times are assigned, the time specified for the reference current waveform is divided by the number of segments to reach the target time. When non-linear target times are assigned, each segment may be assigned a target time in a suitable manner. In one example, the target time may decrease for each subsequent segment. Then, a target current may be specified for each segment.

A fixed clocked PWM control method may be utilized to set the time segments. Thus each cycle is varied in width to achieve the current profile desired. This variance of the duty may be generated by a digital as well as an analog loop. A digital loop may be more adaptive to the varying impedance of the injector. The injector's inductance varies as a function of where the injector is in the waveform. Thus knowing this, the impedance of the load can be taken into account thereby increasing the fidelity of the injector's current waveform as to its desired profile.

This averaged current may be compared to a desired current or current rate to determine the error (e.g., the difference between the measured and desired current). The threshold error may be a suitable difference between the desired and measured current, such as a difference of 5% or 10%.

If the error is not greater than the threshold, method 600 proceeds to 610, which will be explained in more detail below. If the error is greater than the threshold, method 600 proceeds to 608 to adjust the voltage source applied to the solenoid. For example, if the current is higher than the reference current (e.g., if the current rise is faster than desired), the applied voltage may be lowered, for example by lowering the duty cycle of the PWM of the voltage applied to the solenoid. At 610, the current continues to be monitored. In one example, the average current over a second time segment is determined and compared to a desired average current for that time segment to determine a second error. At 612, it is determined if the second error is greater than a threshold (which may be the same threshold as above, or a different threshold). If the second error is not greater than the threshold, method 600 proceeds to 616, which will be explained below.

If the second error is greater than the threshold, method 600 proceeds to 614 to adjust the voltage source applied to the solenoid in order to bring the measured current to the desired current. At 616, fuel injection commences once the threshold current for opening the solenoid is reached, and at 618, the process is repeated for each subsequent solenoid. While FIG. 6 illustrates the error being determined and compared to a threshold twice, it is to be understood that the error determination and adjustment of the voltage source may be made any suitable number of times throughout the adjusted time of the injector. Further, while method 600 described above discloses current control during the initial opening period of the injector, it is to be understood that the closed-loop current control described above may be performed for the entirety of the injector cycle (e.g., from when voltage is first applied to when voltage is no longer applied). Further, while the average voltage applied to the solenoids is described herein as being adjusted via modulation of a switch (e.g., reducing the duty cycle to reduce the current flowing through a solenoid), it is to be understood that other mechanisms of adjusting the current are possible, such as by adjusting the amount of the source voltage.

The current control for two example fuel injectors, according to the method of FIG. 6, is illustrated in FIG. 7. A plot 700 of two example current waveforms for two representative fuel injection events, for example from the first injector and second injector of FIG. 2, is shown. Curve 702 is a current waveform for the first injector and curve 704 is the current waveform for the second injector. Current is depicted along the vertical axis while time is depicted along the horizontal axis. The current waveforms represent two separate, non-concurrently performed fuel injection events.

The adjusted time control performed on the injectors includes the adjusted time being divided into three segments, a first segment between times T0 and T$\mathbf{0}_1$, a second segment between times T$\mathbf{0}_1$ and T$\mathbf{0}_2$, and a third segment between times T$\mathbf{0}_2$ and T1.

Referring to the previously mentioned curve 704, at time T0, the voltage source is applied to the solenoid and as a result current in the solenoid rises. The current is controlled to rise steadily with constant pulse-width modulation, until the threshold current is reached and the injector is opened. This may be due, at least in part, to the second injector having an impedance that matches the predicted impedance for the injector type and thus the current waveform of the second injector matches the reference current waveform. As such, the adjusted time for the second injector is not adjusted away from the calculated adjusted time for the injector.

In contrast, the first injector has a shorter calculated adjusted time due to having a relatively smaller impedance value. Thus, the adjusted time for the first injector is adjusted to be equal to the adjusted time for the second injector, and the applied voltage is modulated (e.g., applied voltage is adjusted) relative to the second injector to have the current in the solenoid reach the threshold at the specified adjusted time.

Thus, as shown by curve 702, at time T0 the voltage source is applied and the current rises at a first rate. At time T$\mathbf{0}_1$, the error between the average measured current for the first injector and the desired current (which may be based on the reference current waveform) is determined and used in the feedback control loop to reduce the voltage applied to the circuit, so that the rate of current rise decreases. As shown by the dashed line, if the current were allowed to rise without modulation of the voltage, it would reach the threshold current faster than the second injector. At time T$\mathbf{0}_2$, the error is again determined and used in the feedback loop, resulting in the applied voltage to again be lowered. This results in a rate of current rise that is substantially similar to the second injector, and the current rises until the threshold current (Tc) is reached at time T1.

The closed loop feedback control described above may be one example method for controlling the current rise of an injector solenoid. FIG. 8 is a method 800 for controlling current rise according to an alternate mechanism. At 802, a voltage source is applied to a first solenoid by turning on a switch between the first solenoid and voltage source. For example, as shown in FIG. 3, a switch may be present between a voltage source and solenoid. The switch may be controlled by a switch driver according to switch on/off logic (e.g., the controller). When the switch is turned on, voltage is applied to the injector circuit, causing an increase in the current at the solenoid. This current is monitored via a current sensor, for example, as indicated at 804.

At 806, it is determined if the first target current is reached. As explained above with respect to FIG. 6, the adjusted time for a given injector may be divided into one or more segments, and a current target and time target assigned to each segment. Once the switch is turned on to a given injector (e.g., the first injector housing the first solenoid), the current rise in that solenoid is monitored until the target current is reached. If the first current target is not yet reached, the method may loop back to continue to monitor current until the first target is reached. Once the first current target is reached, the controller proceeds to 808 to turn off the switch. By doing so, the current rise is controlled to only reach the target current for that segment. The switch remains off for the remaining duration of the target time assigned to that segment.

Accordingly, at 810, the controller determines if the first target time is complete. If not, the controller waits until the target time elapses. Once the target time has elapsed, the controller proceeds to 812 to apply the voltage source to the first solenoid by turning on the switch, and then monitoring current via the current sensor. At 814, the controller includes determining if the second target current is reached. If not, the voltage continues to be applied and the current monitored. Once the second current target is reached, the switch is turned off at 816. At 818, the controller determines if the second target time is complete. If not, the controller loops back to continue to wait for the second target time to elapse. If the second target time is complete, the controller proceeds to apply the voltage source to the first solenoid by turning on the switch. At 822, the fuel injection commences once the threshold current is reached. At 824, the process is repeated for each subsequent solenoid.

The adjusted time control for two example fuel injectors, according to the method of FIG. 8, is illustrated in FIG. 9. FIG. 9 shows a plot 900 of two example current waveforms for two representative fuel injection events, for example from first injector and second injector of FIG. 2. Curve 902 is a current waveform for the first injector and curve 904 is the current waveform for the second injector. Current is depicted along the vertical axis while time is depicted along the horizontal axis. It should be noted that the current waveforms represent two separate, non-concurrently performed fuel injection events.

The adjusted time control performed on the injectors includes the adjusted time being divided into three segments, a first segment between times T0 and T$\mathbf{0}_1$, a second segment between times T$\mathbf{0}_1$ and T$\mathbf{0}_2$, and a third segment between times T$\mathbf{0}_2$ and T1. Each of the segments is assigned a target current, C1, C2, and the threshold current (Tc) for opening the solenoid, respectively.

Referring to curve 904, at time T0, the voltage source is applied to the solenoid and as a result current in the solenoid rises. The current reaches the target current at the same time the time target for each segment is reached, and thus the current is controlled to rise steadily with constant modulation, until the threshold current is reached and the injector is opened. This may be due to the second injector having an impedance that causes the current flowing through the solenoid to match the reference current, and thus the adjusted time for the second injector is not adjusted away from the calculated adjusted time for the injector.

In contrast, the first injector has a shorter calculated adjusted time due to having a smaller impedance. Thus, the adjusted time for the first injector is adjusted to be equal to the adjusted time for reference waveform, and the applied voltage is modulated (e.g., switched on and off) in order to have the current in the solenoid reach the threshold at the specified adjusted time.

Thus, as shown by curve 902, at time T0 the voltage source is applied and the current rises until it reaches the first current target (C1). Once C1 is reached, the voltage source is switched off, and thus the current stops rising for the remainder of the duration of the first segment (e.g., until time T$\mathbf{0}_1$). After time T$\mathbf{0}_1$, the voltage source is again applied to the first injector, and current rises again. Once the current reaches the second current target (C2), the voltage is turned off and current remains steady until time T$\mathbf{0}_2$. After time T$\mathbf{0}_2$, the voltage source is applied and current rises until the threshold current (Tc) is reached at time T1.

Thus, the systems and methods described above provide for controlling fuel injector valve opening such that all injectors of an engine have the same adjusted time, where the adjusted time is defined by the amount of time from when current is applied to a solenoid of an injector to when the fuel injector is actuated open. As described above, fuel injector valve open and close movement is controlled by the current that flows through the injector's solenoids. The current waveform is divided to adjusted, hold 1, and hold 2 time periods. The rise time of the current (adjusted time) in the solenoid is a central parameter to the start timing of fuel injection. Many factors may affect the adjusted time such as the loop impedance which includes solenoid and harness' inductance and resistance. The loop impedance also changes with operating conditions, for example, temperature and fuel pressure.

On some engines, up to sixteen injectors are used, and the injectors are driven by an electronic controller unit (ECU), which may be located in a location from the engine, such as the auxiliary cab, while the injectors are mounted on the engine, next to the auxiliary cab. The harness from each injector to the ECU panel is different in length. Therefore, the impedance in each injector current loop is different. If the same voltage source is applied on sixteen injector loops with different impedances, the current rise times will be different.

To achieve equal adjusted times, the current rise may be actively regulated and controlled so that the adjusted times between injectors are within +/−5 micro seconds, for example. In one example, the control employs a voltage source and control firmware in a field programmable gate array (FPGA) device. The overall rise time is divided to several segments. A pre-set time and current level are assigned to each segment. The current level is monitored constantly. By varying the average voltage of the voltage source applied to the solenoid, the current rise is controlled to reach the pre-set value in each segment. With multiple segments, the overall rise time variation may be within the tolerance as required. The preset time may be linear, that is to divide the overall time to the same segments. Given the dynamic changes of the inductance of the injectors, a non-linear method may be used in which the time segments at start of current and end of adjusted time are different. The voltage source is calculated based on the maximum loop impedance.

The switching frequency and turn on duty cycle may be selected to maintain the current ripple to the minimum. The switching frequency may be a non-fixed value. In this case the switching on and off time depends on the pre-set current levels measured from a current sense circuit.

In another example, an injection value may be determined for at least one of a plurality of fuel injection events for one or more injectors via a controller. The controlled injection value may include a time or duration or rate of current rise in a solenoid of an injector, to provide an adjusted injection value.

With regard to the adjusted injection value being an adjusted time, that includes at least a timing of a fuel injection event measured as a duration from when a voltage source is applied to a solenoid valve of the injector to when current in the solenoid reaches a threshold value to open the injector. A suitable voltage source may include one or more of the following: a battery, capacitor, an alternator, or the like that supplies electrical current through one or more wires in a wire harness.

With regard to the adjusted injection value being an adjusted duration, in pulse width modulated systems, for example, the term refers to the duration from when a current in the solenoid reaches a threshold value to open the injector to when such a value is diminished to the point that the solenoid closes (and therefore stops the flow of fuel therethrough).

With regard to the adjusted injection value being an adjusted rate in the rise of current, for example, the term refers to the amount of time to open the solenoid from when current is first employed to the solenoid. While similar to the adjusted time disclosed above, one difference is that this value does not account for the signal impedance caused by the wiring. It is the responsiveness of the solenoid. The solenoid responsiveness may change over time due to aging and other factors.

The example methods described above with respect to FIGS. 6 and 8 adjust the average voltage supplied to each solenoid of the plurality of fuel injectors in order to match current supplied to each solenoid to a reference current waveform. However, in some examples parameters of each injector drive circuit (e.g., impedance) may be monitored in real time and the average voltage supplied to each solenoid adjusted based on a maximum impedance, as described below with respect to FIG. 5.

FIG. 5 is a flow chart illustrating a method 500 for determining a current rise time for a plurality of fuel injectors. Method 500 may be carried out by a controller according to non-transitory instructions stored thereon. At 502, method 500 includes estimating or measuring engine operating parameters, including but not limited to fuel rail pressure, engine and/or fuel rail temperature, engine speed, engine load, and other parameters. At 504, the impedance for each injector circuit of the fuel system may be determined. The impedance may be based on one or parameters of the harness for each injector circuit. Example parameters may include the length of the harness, wire gauge of the harness, material composition of the harness, or other parameters. Further, the impedance may also be based on environmental factors such as fuel rail pressure and engine and/or fuel rail temperature, and/or based on injector circuit parameters (e.g., solenoid size, amount of applied voltage from voltage source, etc.). These factors will affect the impedance of the injector, according to the terms R+jω and DCR+ inductance. The impedance for each injector circuit may be calculated based the above factors. In other examples, the impedance for each injector circuit may be determined based on a look-up table or other suitable mechanism.

At 506, the amount of voltage to be applied to each injector circuit by a voltage source (e.g., a battery) is set based on the maximum determined impedance. For example, the impedance may be determined for each injector circuit for each injector of the engine, and the circuit with the highest impedance selected. The voltage to be applied may be determined based on the highest impedance and the current rise needed to open the solenoid valve (e.g., the threshold current).

At 508, the target adjusted time for each solenoid is set to the adjusted time for the solenoid with the maximum impedance. As explained above, the injector circuit with the highest impedance is determined, and the adjusted time for that solenoid may be determined based on the applied voltage, threshold current, impedance, and physical parameters of the solenoid (e.g., material, size, composition), which may be determined in advance and stored in the controller.

At 510, the adjusted time for each solenoid is divided into one or more segments. The adjusted time may be divided into a suitable number of segments, such as three segments. At 512, a target time is set for each segment. As indicated at 514, the assignment of target times for each segment may made linearly or non-linearly. That is, for an adjusted time for a given solenoid, each segment may have the same target time (e.g., linear) or one or more segments may have different target times (e.g., non-linear). When linear target times are assigned, the target adjusted time determined at 508 is divided by the number of segments to reach the target time. When non-linear target times are assigned, each segment may be assigned a target time in a suitable manner, so long as the overall adjusted time remains equal to the target adjusted time determined at 508. In one example, the target time may decrease for each subsequent segment.

At 516, a target current rise is set for each segment. In one example, the target current rise may be the threshold current for opening the solenoid divided by the number of segments determined at 510. As indicated at 518, the target current rise may be determined based the calculated impedance for that circuit.

A fixed clocked PWM control method may be utilized to set the time segments. Thus each cycle is varied in width to achieve the current profile desired. This variance of the duty may be generated by a digital as well as an analog loop. A digital loop may be more adaptive to the varying impedance of the injector. The injector's inductance varies as a function of where the injector is in the waveform. Thus knowing this, the impedance of the load can be taken into account thereby increasing the fidelity of the injector's current waveform as to its desired profile.

Thus, method 500 determines an impedance for each injector circuit for a plurality of fuel injectors of an engine. The impedance may be a function of the length of wiring between the injector solenoid valve and the controller and/or voltage source, as well as a function of operating conditions (e.g., fuel rail pressure and temperature, current position of current waveform). A voltage to be applied from a voltage source to each injector is determined based on a maximum calculated impedance and the threshold current needed to open the injector solenoids. The threshold current to open the solenoids may be based on the physical configuration of the solenoids. Based on the voltage and circuit configurations (e.g., impedance, inductance, etc.), the amount of time for each injector to reach the current threshold (the adjusted time) is determined. Because the impedance affects the adjusted time, the circuit with the highest impedance will also have the longest adjusted time.

An embodiment for a system comprises a first fuel injector controlled by a first fuel injector circuit for injecting fuel to a first cylinder; and a controller coupled to the first fuel injector circuit, where the controller is configured to adjust a first actuation signal of the first fuel injector based at least in part on a delay time for the actuation signal or a first wire length from the controller to the first fuel injector. The system may further comprise a second fuel injector controlled by a second fuel injector circuit for injecting fuel to a second cylinder, where the controller adjusts a second actuation signal of the second fuel injector based at least on a second wire length from the controller to the second fuel injector, the second wire length being different than the first wire length. The controller may additionally or alternatively adjust the first actuation signal of the first fuel injector by adjusting a rate of current rise of the first fuel injector circuit and to adjust the second actuation signal of the second fuel injector by adjusting a rate of current rise the second fuel injector circuit. The controller may additionally or alternatively adjust the first actuation signal of the first fuel injector by changing or offsetting a time that the first fuel injector opens or changing a rate at which the injector opens. The controller may additionally or alternatively adjust the rate of current rise of the first fuel injector circuit by adjusting a first switch operable to control application of voltage to the first fuel injector circuit and adjust the rate of current rise of the second fuel injector circuit by adjusting a second switch operable to control application of voltage to the second fuel injector circuit. The second wire may be longer than the first wire, and the controller may additionally or alternatively adjust the first switch and the second switch such that voltage is applied to the second fuel injector circuit for a longer amount of time than voltage is applied to the first fuel injector circuit.

Another embodiment of a system includes an engine having at least a first cylinder and a second cylinder, a first fuel injector circuit for injecting fuel to the first cylinder, the first fuel injector circuit including a first solenoid, a first harness, a first switch, and a first current sensor, a second fuel injector circuit for injecting fuel to the second cylinder, the second fuel injector circuit including a second solenoid, a second harness, a second switch, and a second current sensor, a voltage source coupled to the first fuel injector circuit via the first switch and to the second fuel injector circuit via the second switch, and a controller coupled to the first fuel injector circuit and the second fuel injector circuit. The controller is configured to use a calculated a target adjusted time for the first solenoid and second solenoid based on a maximum impedance of the first fuel injector circuit and second fuel injector circuit, set a target current for each segment of the target adjusted time, during a fuel injection event for the first fuel injector circuit, adjust a position of the first switch based on signals from the first current sensor in order to maintain current in the first solenoid at or below a respective target current for each respective segment of the adjusted time, and during a fuel injection event for the second fuel injector circuit, adjust a position of the second switch based on signals from the second current sensor in order to maintain current in the second solenoid at or below a respective target current for each respective segment of the adjusted time. In an example, the impedance of the second fuel injector circuit is greater than the impedance of the first fuel injector circuit, and the target adjusted time corresponds to an amount of time for the second solenoid to reach the target current. The target adjusted time may comprise a plurality of segments including at least a first segment and a second segment, and the target current may be a target current for the first segment.

In an example of the system, the controller is further configured to set a second target current for the second segment; during the first fuel injection event, adjust a position of the first switch based on signals from the first current sensor in order to maintain current in the first solenoid at or below the second target current for the second segment; and during the second fuel injection event, adjust a position of the second switch based on signals from the second current sensor in order to maintain current in the second solenoid at or below the second target current for the second segment. In an example, the first segment and the second segment comprise equal lengths of time (e.g., within a threshold range of lengths of times). In another example, the first segment and the second segment comprise different lengths of time (e.g., at least one is not within the threshold range of lengths of times). To adjust the position of the first switch based on signals from the first current sensor in order to maintain current in the first solenoid at or below the target current for the target adjusted time, the switch may be opened once current in the first solenoid reaches the target current, until the target adjusted time elapses.

An embodiment for a method carried out on a controller includes determining a first delay time for a first actuation signal sent to a first actuator to switch the first actuator from a first position to a second position; determining a second delay time for a second actuation signal sent to a second actuator to switch the second actuator from a first position to a second position, the second delay time being longer than the first delay time; and adjusting the first actuation signal so that the first delay time is within a threshold range of the second delay time.

In one example, the first actuator is a first fuel injector having a closed first position and an open second position and the second actuator is a second fuel injector having a closed first position and an open second position. The method may further comprise adjusting the first actuation signal so that a first rise time is within five microseconds of a second rise time. The first rise time may be a current rise time of a solenoid of the first fuel injector and the second rise time may be a current rise time of a solenoid of the second fuel injector. The first delay time may be a function of the first rise time and the second delay time may be a function of the second rise time.

In an example, the first delay time is based at least in part on a first length of wire coupling the first fuel injector to the controller and the second delay time is based at least in part on a second length of wire coupling the second fuel injector to the controller, the second length being longer than the first length. Adjusting the first actuation signal may comprise adjusting a current rise time in a solenoid of the first fuel injector. Adjusting the current rise time may comprise determining a difference between a measured current rise time and a target current rise time and adjusting an amount of voltage applied to the solenoid of the first fuel injector based on the determined difference.

Another embodiment relates to a method carried out on a controller. The method comprises determining a first delay time for a first actuation signal sent to a first fuel injector to open the first fuel injector, determining a second delay time for a second actuation signal sent to a second fuel injector to open the second fuel injector, the second delay time being longer than the first delay time, and adjusting the first actuation signal so that the first delay time is equal to the second delay time. The method may include wherein the first delay time is based on a first length of wire coupling the first fuel injector to the controller and the second delay time is based on a second length of wire coupling the second fuel injector to the controller, the second length being longer than the first length. The method may additionally or alternatively include wherein adjusting the first actuation signal comprises adjusting a current rise time in a solenoid of the first fuel injector.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a first fuel injector coupled to a first fuel injector drive circuit and that is operable to inject fuel to a first cylinder; and a controller coupled to the first fuel injector drive circuit, the controller configured to adjust a first actuation signal of the first fuel injector to generate an adjusted first actuation signal of the first fuel injector based at least on an impedance to the first actuation signal, where the controller is configured to adjust the first actuation signal of the first fuel injector by adjusting a rate of current rise of the first fuel injector circuit to track a reference current rise.

2. The system of claim 1, further comprising a second fuel injector controlled by a second fuel injector circuit for injecting fuel to a second cylinder, where the controller is configured to adjust a second actuation signal of the second fuel injector based at least on an impedance to the second actuation signal that differs from the impedance to the first actuation signal.

3. The system of claim 2, where the controller is configured to adjust the second actuation signal of the second fuel injector by adjusting a rate of current rise of the second fuel injector circuit to track the reference current rise, where the second actuation signal is adjusted differently than the first actuation signal.

4. The system of claim 3, further comprising a first wire coupling the first fuel injector to a power source and a second wire coupling the second fuel injector to the power source, and the second wire is longer than the first wire, and the controller is configured to adjust the second actuation signal to account for a longer amount of time after voltage is applied to the first fuel injector circuit for the second fuel injector to open absent the adjustment.

5. A system, comprising:

a first fuel injector coupled to a first fuel injector drive circuit and that is operable to inject fuel to a first cylinder; and a controller coupled to the first fuel injector drive circuit, the controller configured to adjust a first actuation signal of the first fuel injector to generate an adjusted first actuation signal of the first fuel injector based at least on an impedance to the first actuation signal, wherein the controller is configured to adjust the first actuation signal of the first fuel injector by changing a rate at which the first fuel injector opens or by changing or offsetting a time that the first fuel injector opens.

6. The system of claim 1, wherein the first fuel injector is configured to inject fuel responsive to receiving the adjusted first actuation signal.

7. The system of claim 1, wherein the impedance is based at least on a parameter of a first wire of the first fuel injection circuit.

8. A system, comprising:

an engine having at least a first cylinder and a second cylinder;

a first fuel injector circuit for injecting fuel to the first cylinder, the first fuel injector circuit including a first solenoid, a first harness, a first switch, and a first current sensor;

a second fuel injector circuit for injecting fuel to the second cylinder, the second fuel injector circuit including a second solenoid, a second harness, a second switch, and a second current sensor;

a voltage source coupled to the first fuel injector circuit via the first switch and to the second fuel injector circuit via the second switch; and a controller coupled to the first fuel injector circuit and the second fuel injector circuit, where the controller is configured to:

during a fuel injection event for the first fuel injector circuit, adjust an average voltage supplied to the first solenoid by adjusting modulation of the first switch based on signals from the first current sensor in order to maintain current in the first solenoid at or below a target current; and during a fuel injection event for the second fuel injector circuit, adjust an average voltage supplied to the second solenoid by adjusting modulation of the second switch based on signals from the second current sensor in order to maintain current in the second solenoid at or below the target current.

9. The system of claim 8, wherein an impedance of the second fuel injector circuit is greater than an impedance of the first fuel injector circuit, and wherein the second switch is modulated differently than the first switch.

10. The system of claim 8, wherein the first fuel injection event and second fuel injection event are each divided into a plurality of segments including at least a first segment and a second segment, and wherein the target current is a reference current for the first segment.

11. The system of claim 10, wherein the controller is further configured to:

set a second target current for the second segment;

during the first fuel injection event, adjust the average voltage supplied to the first solenoid by adjusting modulation of the first switch based on signals from the first current sensor in order to maintain current in the first solenoid at or below the second target current for the second segment; and during the second fuel injection event, adjust the average voltage supplied to the second solenoid by adjusting modulation the second switch based on signals from the second current sensor in order to maintain current in the second solenoid at or below the second target current for the second segment.

12. The system of claim 11, wherein the first segment and the second segment comprise equal lengths of time.

13. The system of claim 11, wherein the first segment and the second segment comprise different lengths of time.

14. A method carried out on a controller, comprising:

determining a first delay time for a first actuation signal sent to a first fuel injector to switch the first fuel injector from a closed first position to an open second position;

determining a second delay time for a second actuation signal sent to a second fuel injector to switch the second fuel injector from a closed first position to an open second position, the second delay time being longer than the first delay time; and adjusting the first actuation signal so that a first current rise time of the first fuel injector is within a threshold range of a second current rise time of the second fuel injector.

15. The method of claim 14, wherein the threshold range is five microseconds.

16. The method of claim 14, wherein the first delay time is based at least in part on a first length of wire coupling the first fuel injector to the controller and the second delay time is based at least in part on a second length of wire coupling the second fuel injector to the controller, the second length being longer than the first length.

17. The method of claim 14, wherein adjusting the first actuation signal comprises adjusting the first current rise time of the first fuel injector.

18. The method of claim 17, wherein adjusting the first current rise time comprises determining a difference between a measured current rise time and a target current rise time and adjusting an amount of voltage applied to a solenoid of the first fuel injector based on the determined difference.

19. A method comprising:

with a first fuel injector coupled to a first fuel injector drive circuit, injecting fuel to a first cylinder; and with a controller coupled to the first fuel injector drive circuit, adjusting a first actuation signal of the first fuel injector to generate an adjusted first actuation signal of the first fuel injector based at least on an impedance to the first actuation signal, wherein adjusting the first actuation signal of the first fuel injector comprises adjusting a rate of current rise of the first fuel injector circuit to track a reference current rise.

* * * * *